US010362386B2

(12) United States Patent
Jaguste

(10) Patent No.: US 10,362,386 B2
(45) Date of Patent: Jul. 23, 2019

(54) LOUDSPEAKER ENCLOSURE WITH A SEALED ACOUSTIC SUSPENSION CHAMBER

(71) Applicant: KEYOFD AKTIEBOLAG, Johanneshov (SE)

(72) Inventor: Rohan Jaguste, Johanneshov (SE)

(73) Assignee: Keyofd Aktiebolag, Johanneshov (SE)

( * ) Notice: Subject to any disclaimer, the term of this patent is extended or adjusted under 35 U.S.C. 154(b) by 0 days.

(21) Appl. No.: 15/549,521

(22) PCT Filed: Feb. 12, 2016

(86) PCT No.: PCT/SE2016/050110

§ 371 (c)(1),
(2) Date: Aug. 8, 2017

(87) PCT Pub. No.: WO2016/130077

PCT Pub. Date: Aug. 18, 2016

(65) Prior Publication Data

US 2018/0027321 A1 Jan. 25, 2018

(30) Foreign Application Priority Data

Feb. 13, 2015 (SE) ..... 1550164

(51) Int. Cl.
*H04R 1/28* (2006.01)
*H04R 1/02* (2006.01)
*H04R 29/00* (2006.01)

(52) U.S. Cl.
CPC ..... *H04R 1/2803* (2013.01); *H04R 1/288* (2013.01); *H04R 1/2826* (2013.01);
(Continued)

(58) Field of Classification Search
CPC .. H04R 1/2803; H04R 1/2834; H04R 1/2842; H04R 1/2896; H04R 1/288; H04R 1/2826; H04R 29/001
(Continued)

(56) References Cited

U.S. PATENT DOCUMENTS 4,076,097 A * 2/1978 Clarke ..... H04R 1/2834 181/147
4,286,688 A 9/1981 OMalley
(Continued)

FOREIGN PATENT DOCUMENTS

CN 202454272 U 9/2012
EP 0340345 A2 11/1989
(Continued)

OTHER PUBLICATIONS

Office Action dated Sep. 11, 2015 in corresponding SE Application No. 1550164-6.
(Continued)

*Primary Examiner* — Thjuan K Addy
(74) *Attorney, Agent, or Firm* — Knobbe, Martens, Olson & Bear, LLP

(57) ABSTRACT

The present invention relates to a loudspeaker enclosure housing a sealed acoustic suspension chamber. In the sealed acoustic suspension chamber are arranged a driver and a passive acoustic diaphragm on opposite sides of an inner surface of the sealed acoustic suspension chamber. The loudspeaker enclosure also houses a first band-pass chamber connected to the sealed acoustic suspension chamber by the passive acoustic diaphragm.

17 Claims, 8 Drawing Sheets

(52) U.S. Cl.
CPC ..... *H04R 1/2834* (2013.01); *H04R 1/2842* (2013.01); *H04R 1/2896* (2013.01); *H04R 29/001* (2013.01); *H04R 1/026* (2013.01); *H04R 1/028* (2013.01); *H04R 2201/028* (2013.01); *H04R 2499/11* (2013.01); *H04R 2499/13* (2013.01)

(58) Field of Classification Search
USPC ..... 381/59, 304, 305, 311, 26, 28
See application file for complete search history.

(56) References Cited

U.S. PATENT DOCUMENTS

| | | | | |
|---|---|---|---|---|
| 4,379,951 | A | 4/1983 | Gabr | |
| 4,870,691 | A | 9/1989 | Mindel | |
| 6,389,146 | B1 * | 5/2002 | Croft, III ..... | H04R 1/2842 381/345 |
| 2006/0078136 | A1 | 4/2006 | Stiles et al. | |
| 2006/0078144 | A1 | 4/2006 | Stiles et al. | |
| 2007/0058830 | A1 | 3/2007 | Setiabudi et al. | |
| 2014/0341394 | A1 * | 11/2014 | Croft, III ..... | H04R 1/2811 381/102 |

FOREIGN PATENT DOCUMENTS

| | | | |
|---|---|---|---|
| EP | 1487235 | A2 | 12/2004 |
| WO | 01/60114 | A2 | 8/2001 |
| WO | 01/62043 | A1 | 8/2001 |
| WO | 2012/051217 | A2 | 4/2012 |

OTHER PUBLICATIONS

ExtendedEuropean Search Report for EP Application No. 16749544, dated Dec. 5, 2018, in 13 pages.

* cited by examiner

LOUDSPEAKER ENCLOSURE WITH A SEALED ACOUSTIC SUSPENSION CHAMBER

CROSS-REFERENCE TO RELATED APPLICATIONS

This application is the U.S. National Phase under 35. U.S.C. § 371 of International Application PCT/SE2016/050110, filed Feb. 12, 2016, which claims priority to Swedish Patent Application No. SE 1550164-6, filed Feb. 13, 2015. The disclosures of the above-described applications are hereby incorporated by reference in their entirety.

TECHNICAL FIELD

The present invention relates to a loudspeaker enclosure housing a sealed acoustic suspension chamber. In the sealed acoustic suspension chamber are arranged a driver and a passive acoustic diaphragm on opposite sides of an inner surface of the sealed acoustic suspension chamber, and the loudspeaker enclosure also houses a first band-pass chamber connected to the sealed acoustic suspension chamber by the passive acoustic diaphragm.

BACKGROUND ART

Accurate high quality reproduction of audio signals, also referred to as high fidelity reproduction, is among others preferred in the music industry while monitoring sound during for instance music recording, sound mastering and audio engineering. Accurate high quality reproduction of pre-recorded audio signals is also preferred by musicians and audiophiles.

A loudspeaker is a device that converts an electrical audio signal or impulse into corresponding sound. The loudspeaker typically consists of a purpose-engineered enclosure, housing at least one loudspeaker driver, also called transducer, and associated electronic equipment, such as crossover circuits and amplifiers. A transducer is a device that converts an electrical signal into variations in a physical quantity, such as sound, the conversion being the operating principle behind generally available loudspeaker systems and applications.

Loudspeaker enclosures range in design from simple, rectangular particle-board chambers to highly sophisticated cabinets with advanced geometries. Those advanced, more complex enclosures may incorporate composite materials and state of the art components. The geometry of the enclosures, internal and external may also comprise internal sub-chambers defined and delimited by passive acoustic radiators and/or passages there between. Expressions used for such inner or outer passages between sub-chambers are vents (ventilation passages), ports and diaphragms.

Conventional loudspeakers use the mentioned variety of enclosures, chambers and sub-chambers, components and driver arrangements to reproduce sound within and beyond the commonly accepted range of human hearing, which is between 20 Hz and 20 kHz. A full-range driver is a type of driver designed to reproduce most of the audible frequencies. Due to physical and technical limitations no driver in use today can audibly reproduce all the frequencies within this range all by itself. To overcome this limitation, it is therefore common for loudspeakers to utilise at least two distinct drivers. The low- and mid-range frequencies from 20 Hz to up to 1500 Hz are produced using a woofer, and the high range frequencies from 1500 Hz to 20 kHz are produced using a tweeter respectively.

Despite use of a twin driver arrangement according to the above, very low frequencies are usually still attenuated well below audible levels. To counteract this, the so-called high-end loudspeakers typically reproduce sound utilising at least three drivers, using a dedicated low frequency woofer for reproducing the low frequencies (bass), and the mid-range driver and the tweeter for reproducing the remaining frequencies respectively. Dedicated sub-woofers also employ this low frequency woofer to the same effect.

When more than one driver is used in a loudspeaker, a crossover circuit is required to ensure that the multiple drivers do not reproduce the same frequencies, which could result in interference, such as undesired coloration or cancellation of the sound waves being generated. The crossover circuit in most cases is a combination of simple band-pass filters constructed using inductors, capacitors and resistors of high quality. The use of a crossover circuit can allow for near optimal sound reproduction, but not without the overhead of lowered operating efficiency and energy loss through dissipated heat. For crossover circuits to function properly and not impair a near optimal reproduction of sound, they need to be made from high quality components. With this requirement comes the inevitable disadvantage of adding considerable hardware costs to a sound system besides increasing complexity of the system.

Yet another difficulty to consider during construction and production of loudspeakers with multiple drivers is tolerance. Precise alignment and positioning of each driver on the baffle of the loudspeaker enclosure with respect to any other drivers is crucial for accurate sound reproduction, as even minor deviations from the optimal alignment can lead to undesired coloration or distortion of the generated sound.

A loudspeaker enclosure can be used as a means to extend the low frequency response of the woofer driver. For example, the enclosure can be designed to resonate at certain low frequencies by ventilating the volume of the air inside the enclosure via a port, thus increasing the low frequency (bass) output from the loudspeaker. Variations of this port, which in effect has the function of a so-called Helmholtz resonator, have been devised to optimise a wide range of woofer drivers. Such enclosures usually require a relatively large internal volume compared with the available space for housing such a volume and the desire to keep outer dimensions of loudspeaker enclosures smallest possible.

Some loudspeakers utilise one or more passive acoustic diaphragms, which is a type of passive acoustic radiator and which will be referred to as passive radiator henceforth, in place of ports. A passive radiator is a driver without a magnet, voice coil and terminal assembly, and is hence not physically connected or wired to the amplifier. When coupled with a suitable driver, the passive radiator vibrates in response to the changing air pressure inside the loudspeaker enclosure caused by the vibrating driver. Unlike for a port, the resonance frequency of the passive radiator can be accurately tuned by changing its vibrating mass. Thus, tuning adjustments for a passive radiator can be accomplished more quickly than for the case of the more conventional bass reflex design, since such corrections can be as simple as a mass adjustment to its diaphragm. Disadvantages are that a passive radiator must be manufactured with small tolerances quite like a driver. This increases production costs besides the limitations in excursion, which applies to passive acoustic diaphragms.

Several types of loudspeaker enclosure designs have been proposed for accurate reproduction of audio signals. One such design uses woofer drivers mounted inside sealed enclosures, with or without additional passive radiators. This type of enclosure provides an excellent transient response characteristic. Nevertheless, this design does not extend the low frequency response of the driver below its own resonance frequency, or below the resonance frequency of the passive radiators if any. Another design, typically created for extending the low frequency response several loudspeakers, utilises a band-pass enclosure design which is achieved by sub-dividing the internal volume of the enclosure into multiple sub-chambers of varying volumes. Many high end sub-woofers on the market use the band-pass enclosure design.

An example of such a design is reflected in U.S. Pat. No. 6,389,146, wherein a band-pass loudspeaker enclosure includes three sub-chambers, the first one being a non-Helmholtz-reflex chamber of a sealed acoustic suspension type, and the remaining two chambers utilising two passive acoustic radiators to achieve two Helmholtz-reflex ventilation tunings. Moreover, multiple of low pass acoustic filters are arranged to provide an acoustic band-pass with a substantially second order high pass characteristic combined with an extended, steeper, at least fourth order slope low pass stop band characteristic. The use of multiple low pass, acoustic filter characteristic filters out internal resonances and minimises their acoustical output. A disadvantage of the described loudspeaker design is that band-pass enclosures tend to have a poorer transient response as compared to that of sealed enclosures.

To achieve optimal low frequency response, band-pass enclosures require considerable internal volume and hence have to be large in size, which means that they become heavy and bulky to handle. Furthermore, both of the aforementioned designs require the use of multiple drivers, a woofer, a mid-range driver and a tweeter, as well as and a crossover circuit for accurate reproduction of audio signals. This not only increases the unit cost, but also leads to coloration of the sound being reproduced. Furthermore, the use of multiple drivers and a crossover circuit also increases energy consumption.

The invention aims at overcoming some of the mentioned disadvantages related to accurate sound reproduction in conventional audio systems generally and loudspeakers and their enclosures in particular.

SUMMARY OF THE INVENTION

It is therefore an object of the present invention to obviate or at least alleviate shortcomings associated with prior art technology. This object is attained at by means of a loudspeaker enclosure which houses a sealed acoustic suspension chamber, the sealed acoustic suspension chamber comprising a driver and a passive acoustic diaphragm being arranged on opposite sides of an inner surface of the sealed acoustic suspension chamber. The loudspeaker enclosure also houses a first band-pass chamber connected to the sealed acoustic suspension chamber by the passive acoustic diaphragm, and is characterised in that the inner surface of the sealed acoustic suspension chamber is continuously curved.

In loudspeaker design art, there is an effect known as the Hoffman's Iron Law, which states that a loudspeaker can only possess any two of the following three characteristics: small volume, high sensitivity and extended low frequency response. All these three characteristics are of course desirable, but so far due to physical and technical limitations this has not been accomplished. In accordance with the present invention, all three of the aforementioned desirable features are realised in its embodiments, thus giving the invention an advantage over most contemporary loudspeaker designs.

The continuously curved shape of the sealed acoustic suspension chamber in combination with a driver coupled with a passive acoustic diaphragm housed in a sealed acoustic suspension chamber has many advantages. An example is extension of the low frequency response down to the resonance frequency of the passive acoustic diaphragm. The continuously curved shape of the sealed acoustic suspension chamber also results in an improved transient response from both the driver and the passive acoustic diaphragm, which results in more accurate sound reproduction, i.e. enhanced quality of the sound generated by the loudspeaker.

The mentioned improved transient response in turn results in improved dynamic power handling capability, which leads to better operating efficiency without compromising the dynamics of the reproduced sound.

The driver and the passive acoustic diaphragm being arranged on opposite sides of the inner surface of the sealed acoustic suspension chamber allows for a more precise coupling of the passive acoustic diaphragm with the driver in the sealed enclosure. This leads to an improved transient response of the loudspeaker enclosure.

In accordance with one embodiment of the present invention, the driver and the passive acoustic diaphragm are integrally formed with the sealed acoustic suspension chamber.

When the driver and the passive acoustic diaphragm are integrally arranged with each other, thus forming a tightly sealed chamber, acoustic leaks consisting of pressurised air can be almost entirely avoided. Air leaks are generally a substantial cause of reduced efficiency and acoustic distortion in loudspeaker enclosures.

In accordance with an alternative embodiment, the driver is a full-range driver, i.e. a driver which is able to reproduce sound over most of the audible spectrum.

By using one full-range driver to reproduce most of the frequencies within the audible range of 20 Hz to 20 kHz, the need for multiple drivers and a crossover circuit is eliminated, thus reducing unit costs. Very low frequencies, i.e. below 80 Hz, are audibly reproduced by using the aforementioned embodiment in combination with the full-range driver. Further benefits by using a full-range driver instead of multiple drivers is that energy consumption of the loudspeaker is reduced and that the size of the loudspeaker enclosure can be reduced.

In one embodiment of the present invention, the surface area of the passive acoustic diaphragm is equal to or larger than the surface area of a corresponding diaphragm of the driver.

Arranging the loudspeaker enclosure so that the surface area of the passive acoustic diaphragm is at least the size of the diaphragm of the driver or large, typically two times the size, further improves transient response and enhances operating efficiency and acoustic performance from both the driver and the passive acoustic diaphragm. The coupling of the driver with a suitable passive acoustic diaphragm is determined by the acoustic compliance of both the driver and the passive radiator.

Furthermore, by using a passive acoustic diaphragm with a surface area greater than that of the driver, it becomes physically possible to reproduce lower frequencies than otherwise. This implies that the frequency response of the embodiment can be extended well below that of the smaller sized driver without the need for a larger woofer driver or large internal volume.

According to a further embodiment of the loudspeaker enclosure according to the invention, the sealed acoustic suspension chamber is substantially spherical.

In addition to the effects relating to a continuously curved suspension chamber according to the above discussion, a substantially spherical shape of the suspension chamber is even more beneficial. When the driver and the passive radiator are arranged on opposite sides of a sealed chamber that is substantially spherical, the internal diffraction of the rearward propagated sound waves from the driver is greatly minimised resulting in an efficient transfer of energy to the passive radiator through pistonic coupling.

Furthermore, a sphere has the smallest surface area of all surfaces that enclose a given volume, implying an optimal volume of air that matches the compliance of the driver can be enclosed in the smallest possible chamber. In other words, the internal volume of the sealed acoustic suspension chamber can be minimised. Therefore, a sphere, or at least an almost spherical shape would be ideal, although other limitations in connection with the design or production of loudspeakers may in practice prevent this shape from being realised.

According to an alternative embodiment of the present invention, the loudspeaker enclosure houses at least a second band-pass chamber, the chamber being connected to the first band-pass chamber by the passive acoustic radiator.

The provision of an optional second band-pass chamber exhibits the properties of a second order low-pass filter, which further extends the low frequency response of the loudspeaker enclosure of the present invention. The optional second band-pass chamber enables improved low frequency response without compromising the overall transient response of the sealed acoustic chamber embodiment.

In one embodiment of the present invention, the sealed acoustic suspension chamber is made from a homogenous material of high density. Conceivable materials for use are high density fibreboard (HDF), ceramics or polymer composites, but also medium density fibreboard (MDF) could be used.

When a homogenous material of high density is used to construct the loudspeaker enclosure, the resulting embodiment exhibits the characteristic of an acoustically consistent volume. Such an acoustically consistent volume allows the timbre, i.e. the character or quality of a musical sound or voice as distinct from its pitch and intensity, to remain consistent throughout the structure of the enclosure. Undesired coloration or distortion of the sound by the enclosure itself can thus be avoided.

An alternative embodiment of the present invention discloses an arrangement in which the loudspeaker enclosure contains foam or magnetic levitating feet in order to acoustically isolate the enclosure.

BRIEF DESCRIPTION OF THE DRAWINGS

Referring now to the drawings, in which like numerals refer to like parts throughout the several views, exemplary embodiments of the present invention are described.

DETAILED DESCRIPTION

The general object or idea of embodiments of the present disclosure is to address at least one of the disadvantages with the prior art solutions described above. The various alternative embodiments described below in connection with the figures should be primarily understood in a logical sense and the scope of protection of the present invention be ascertained with reference to the appended claims.

Figure 1:
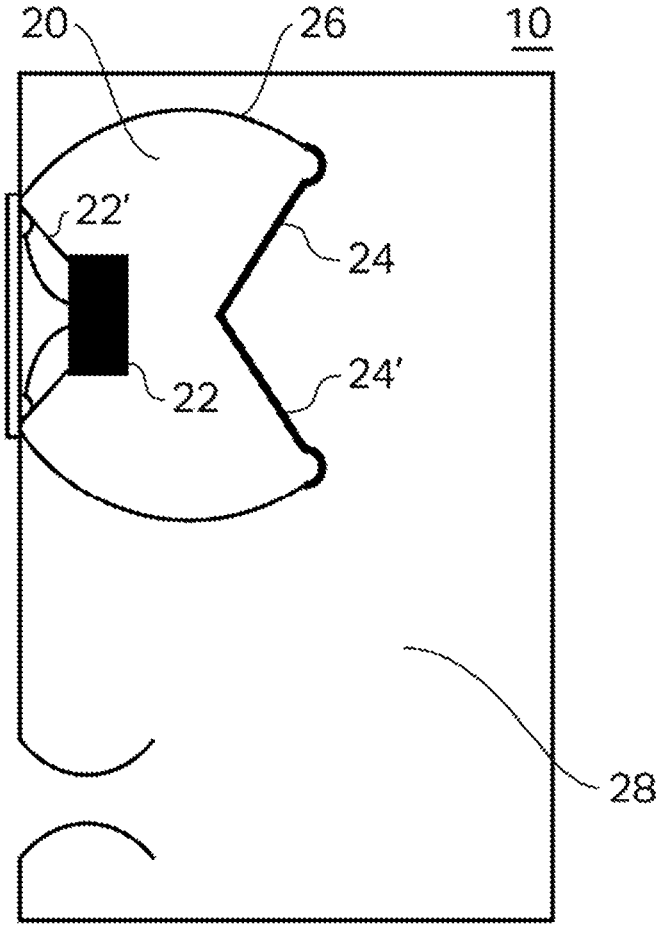
FIG. 1 shows an overview of the loudspeaker enclosure arrangement comprising a first band-pass chamber according to a first embodiment of the present invention.

With reference to FIG. 1 is disclosed a loudspeaker enclosure 10. The loudspeaker enclosure houses a sealed acoustic suspension chamber 20, the suspension chamber comprising a driver 22 and a passive acoustic diaphragm 24, which are arranged relative each other on opposite sides of an inner surface 26 of the sealed acoustic suspension chamber. The sealed acoustic suspension chamber is made from a homogenous material and/or acoustically neutral material of high density, such as high density fibreboard (HDF), ceramics or polymer composites. The loudspeaker enclosure also houses a first band-pass chamber 28 connected to the sealed acoustic suspension chamber by the passive acoustic diaphragm. Moreover, in accordance with one embodiment of the present invention, the inner surface of the sealed acoustic suspension chamber is continuously curved.

Figure 2:
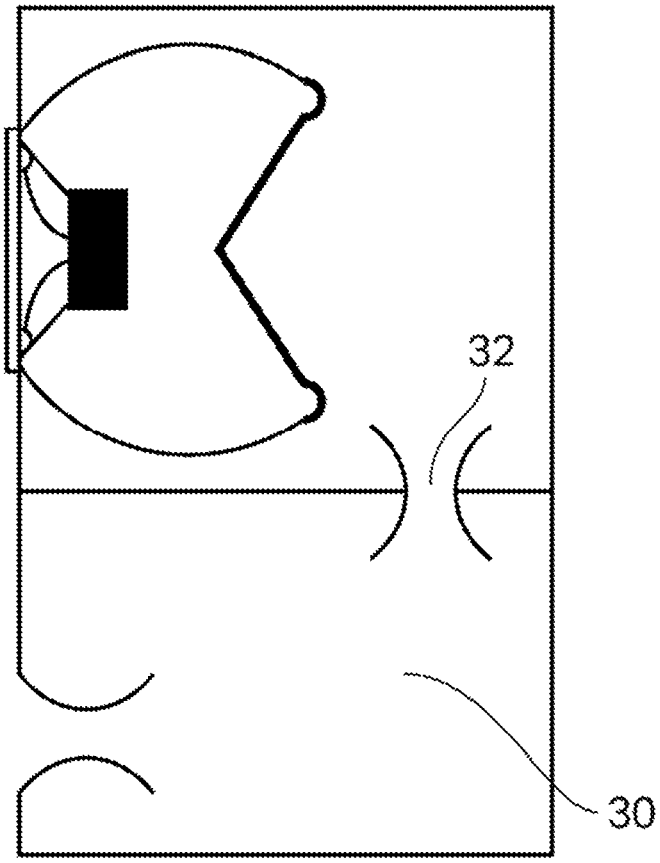
FIG. 2 shows a loudspeaker enclosure comprising a second band-pass chamber in addition to the first band-pass chamber, the second band-pass chamber being connected to the first-band-pass chamber by a passive acoustic diaphragm in accordance with an alternative embodiment of the present invention.

With reference to FIG. 2, the loudspeaker enclosure is arranged to house at least a second band-pass chamber 30, the second band-pass chamber being connected to the first band-pass chamber by a passive acoustic radiator 32 of the port-type with flared ends.

Figure 3:
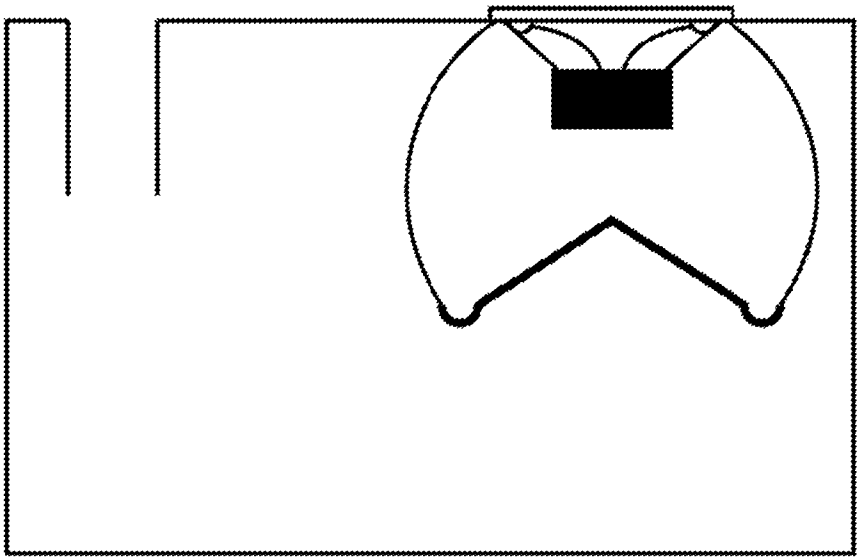
FIGS. 3-5 show loudspeaker enclosure arrangements with different designs, all having a first band-pass chamber with ventilations in a variety of directions.
Figure 4:
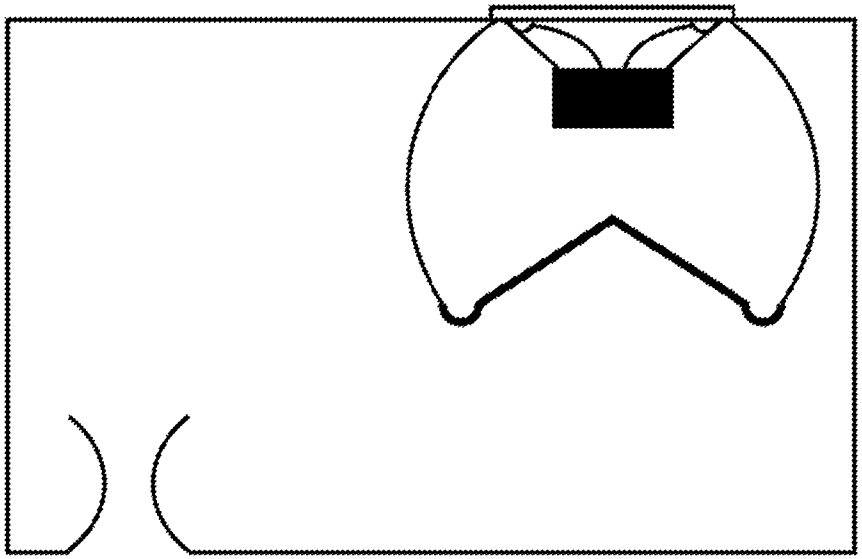
Figure 5:
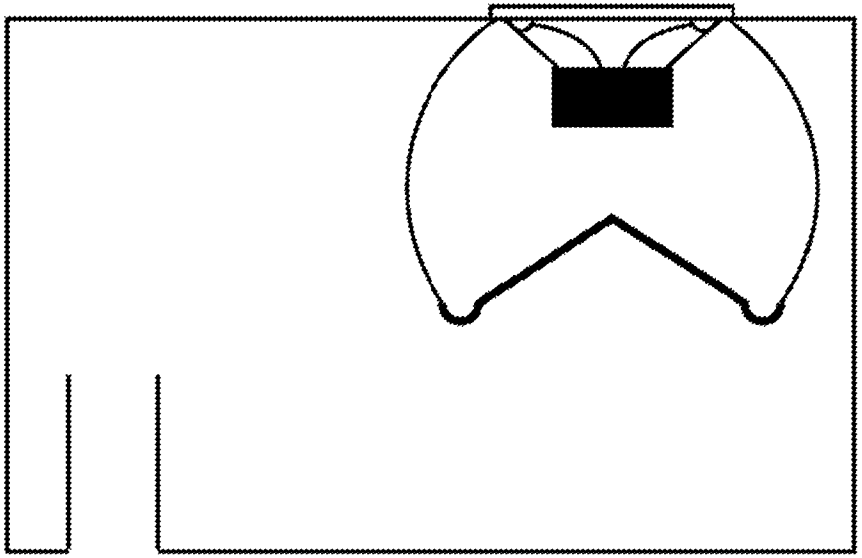

With further reference to FIGS. 3-5, conceivable loudspeaker enclosure arrangements are shown with different designs, all having a first band-pass chamber with ventilations in a variety of directions. Both the design of the ventilation passages and the direction in which the opening is provided may differ. The design could be with either straight walls or curved walls, then with a flared or linear section in-between the inner and outer openings of the ventilation passage of the first band-pass chamber.

Figure 6:
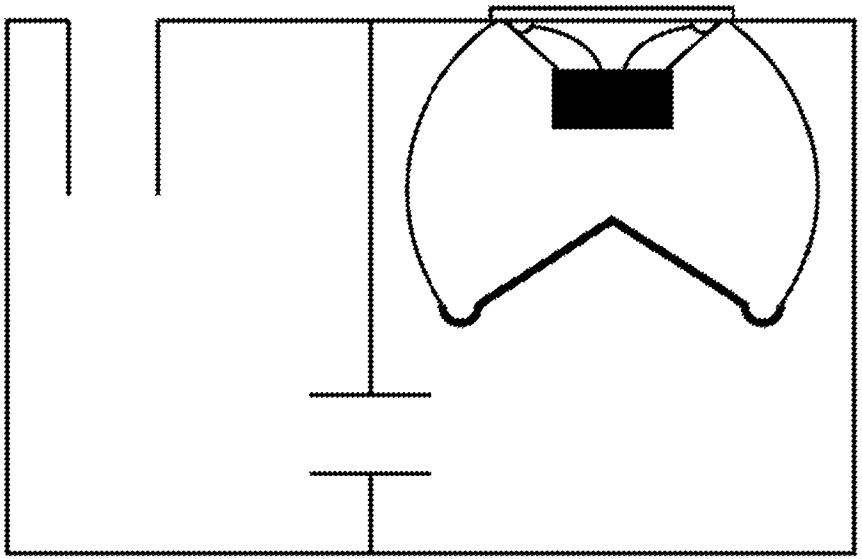
FIGS. 6-8 show loudspeaker enclosure arrangements with different designs, all having first and second band-pass chamber in connection with each other and with ventilations of the second band-pass chamber in a variety of directions.
Figure 7:
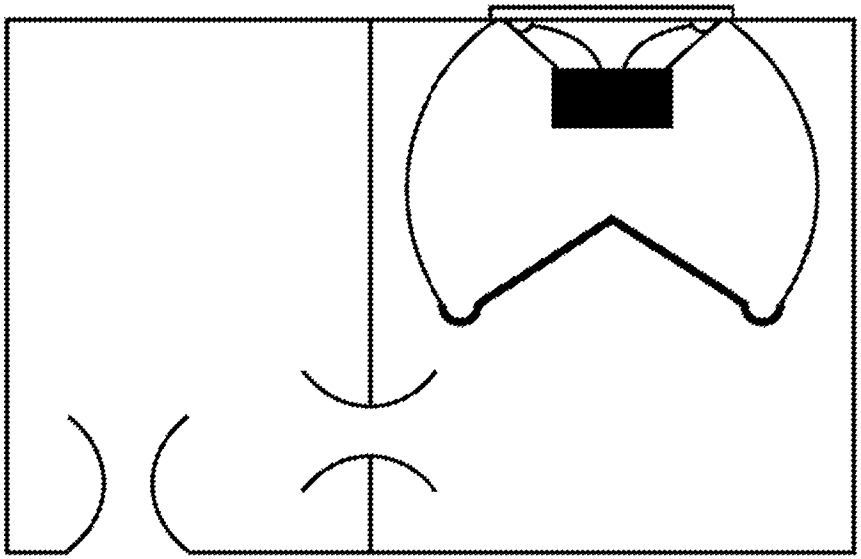
Figure 8:
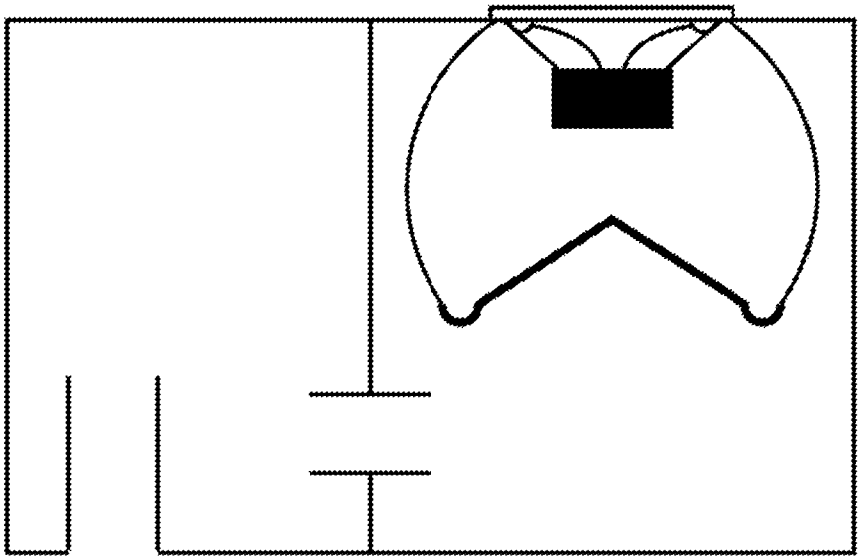

With further reference to FIGS. 6-8, conceivable loudspeaker enclosure arrangements are shown with different designs, all having first and second band-pass chamber in connection with each other and with ventilations of the second band-pass chamber in a variety of directions. In accordance with previously described FIGS. 3-5, both the design of the ventilation passages and the direction in which the opening is provided may differ. The design could be with either straight walls or curved walls, then with a flared or linear section in-between the inner and outer openings of the ventilation passage of the additionally provided second band-pass chamber.

From a functional perspective, conventional audio systems generally and loudspeakers and their enclosures in particular have long been based on more or less the same principles for construction. Materials used, design and production methods have slowly developed, but still, at least from the outside, not much seems to have happened. Comparing with consumer electronics and the computer industry for example, the pace of development has been substantially slower for loudspeaker technology.

However, during the last years, the field has evolved by the introduction of new materials for use when producing enclosures for loudspeakers and previously unknown methods of manufacturing have been proposed. The present invention proposes materials to be used for the loudspeaker enclosure having acoustically isolating properties. In addition to that, automated manufacturing methods are proposed employing CNC-milling of a high density, homogeneous and acoustically neutral material so as to obtain more accurate reproduction of sound, high performance and consistent quality, while keeping production costs, required size and complexity to a minimum.

When a driver is mounted on a sealed acoustic suspension chamber, the embodiment exhibits the characteristic of a critically damped system. This implies that when audio power through an audio signal is supplied to the driver, its diaphragm will vibrate to match the amplitude of the audio signal with high accuracy. The volume of air trapped inside the sealed acoustic suspension chamber critically damps the driver. This corresponds to a precise transient (impulse) response characteristic. Such an arrangement requires a marginal increase in the supplied audio power to counter internal air pressure.

When a passive radiator, or passive acoustic diaphragm, is mounted on the opposite side of the driver within the mentioned hermetically sealed chamber, the resulting arrangement exhibits characteristics similar to that of pneumatic piston wherein the rearward facing passive radiator vibrates near instantaneously in response to the vibrating forward facing driver, albeit 180° out of phase from driver. Thus, the precise transient response characteristic is preserved.

Furthermore, the acoustic compliance of a system according to the present invention is increased, which drives the passive radiator without the need for an increase in the audio power supplied to the driver. When the driver and the passive radiator are arranged on opposite sides of a sealed chamber that is continuously curved or even substantially spherical or spherical, the internal diffraction of the rearward propagated sound waves from the driver is greatly minimised resulting in an efficient transfer of energy to the passive radiator.

As previously mentioned, a continuously curved, or to be more precise, a spherical inner surface of the sealed acoustic suspension chamber exhibits the smallest surface area of all surfaces that enclose a given volume. This enables an optimal volume of air to be used that matches the compliance of the driver that can be enclosed in the smallest possible chamber.

The inner surface of the sealed acoustic suspension chamber is continuously curved according to the present invention. The curvature may take various forms and dimensions depending on the intended use of the loudspeaker and its locality. A variety of uses and localities are feasible for loudspeaker enclosures according to the invention, of which one is for musical instrument amplifiers. The form and dimension of the loudspeaker enclosure will need to be adapted for use in musical instrument amplifiers, depending on the musical instrument it serves to amplify. However, irrespective of the adaptation, the benefit of the invention will remain, i.e. high fidelity sound reproduction, excellent transient response and extended bass response from a small sized amplifier. This will mean that the musical instruments sound true to their original sound even after being amplified. Conceivable musical instruments for use in connection with the present invention are acoustic guitars, acoustic bass guitars and contra basses, string, brass and woodwind instruments, organs, acoustic pianos and of course human vocals. As for electrified musical instruments, the amplifier component will comprise additional digital signal processing to manipulate gain, feedback and distortion.

The invention as claimed can be modified for reproduction of sound particularly in small to medium sized cinemas and concert halls. Adapting the invention for larger spaces will require more powerful components but although the forms and dimensions may differ from other applications, the mentioned advantages of the invention will remain.

Although some minor modifications may be necessary, other conceivable fields of application of the present invention are in headphones or as integrated loudspeakers inside vehicles. Yet another applications is integrated loudspeakers for electronic devices, taking the tighter and more stringent space constraints into careful consideration. For the invention to be used in electronic devices, the design of the electronic device itself could be changed. For example, using the frame or the body of a laptop or mobile phone, two types of devices having substantially larger surface area than the components inside, the device itself could become a conduit to channel low frequencies. Hence, according to the invention the body of the device could be integrated as part of its own.

A further aspect of the invention includes a three-point magnetic suspension. This magnetic suspension, preferably realised as a sub-assembly inside the loudspeaker enclosure, is arranged to suspend the coupler between three points (top, right and left) inside the enclosure. The purpose is not only to allow for damped suspension of the loudspeaker drivers, but also to allow the ease of assembly, disassembly and to achieve a monolithic design, which in turn allows for the enclosure to be sealed air-tight by means of its own weight. Vibrational forces from the loudspeaker drivers are first absorbed by silicon and neoprene gaskets being part of the magnetic suspension, and finally by a thicker neoprene gasket placed between the body and base of the loudspeaker enclosure. This replaces the need for loudspeaker feet and vibration damping mats, which are often costly and add little or no value as compared to this magnetic suspension arrangement.

In accordance with one embodiment of the invention, a positioning and clipping indicator is provided. The indicator includes an LED inside the bass port of each of the two loudspeaker enclosure pairs. A user positioning for listening to will be able to see the lit LED only when his/her eyes, and hence his/her ears, are in the sweet spot of the loudspeakers. By sweet spot is here meant that the user is in an ideal listening position in relation to a pair of loudspeaker enclosures. Basic triangulation and parallax logic is applied, similar to the arrangement of the positioning indicators used on airplane cockpits that allow pilots to correctly adjust their seat orientation inside the cockpit.

Conceivably, piezo transducers and diode rectifiers are used to absorb, i.e. pick up, vibrations from the coupler and generate enough electrical current to drive the LED. Toroidal chokes and/or inductors are another conceivable arrangement, and the wire carrying the audio signal to the loudspeaker will generate a tiny electromagnetic field sufficient to charge a capacitor that drives the LED. Both of these arrangements by their design provide the added advantage of using the positioning indicator also as a clipping indicator which lights up when the loudspeaker driver starts operating near its threshold, signaling to the user to reduce the amplitude of the input signal.

According to yet an alternative embodiment, the LED could be powered using a magnetic propeller arrangement. Radially housed magnets on a small propeller which are put into rotational motion when a larger powerful magnet is held at an angle from the propeller. The turning propeller then generates a reverse current that powers the LED. The magnetic propeller arrangement could also be used to cool the amplifier. A further arrangement could be to use a light radiating surface in place of the LED.

What is claimed is:

1. A loudspeaker comprising:

an enclosure and a sealed acoustic suspension chamber comprising a driver and a passive acoustic diaphragm being arranged on opposite sides of an inner surface of the sealed acoustic suspension chamber, wherein the loudspeaker enclosure houses the sealed acoustic suspension chamber and a first band-pass chamber connected to the sealed acoustic suspension chamber by the passive acoustic diaphragm, and the inner surface of the sealed acoustic suspension chamber is continuously curved.

2. The loudspeaker according to claim 1, wherein the driver and the passive acoustic diaphragm are integrally formed with the sealed acoustic suspension chamber.

3. The loudspeaker according to claim 1, wherein the driver is a full-range driver.

4. The loudspeaker according to claim 1, wherein the surface area of the passive acoustic diaphragm is equal to or larger than the surface area of a corresponding acoustic diaphragm of the driver.

5. The loudspeaker according to claim 1, wherein the sealed acoustic suspension chamber is substantially spherical.

6. The loudspeaker according to claim 1, wherein the loudspeaker enclosure houses at least a second band-pass chamber, the chamber being connected to the first band-pass chamber by a passive acoustic radiator.

7. The loudspeaker according to claim 1, wherein the sealed acoustic suspension chamber is made from a homogenous material of high density, such as high density fibreboard (HDF), ceramics or polymer composites.

8. The loudspeaker according to claim 1, wherein the sealed acoustic suspension chamber is made from an acoustically neutral material, such as high density fibreboard (HDF), ceramics or polymer composites.

9. The loudspeaker according to claim 1, wherein the enclosure is acoustically isolated using foam or magnetic levitating feet, or a combination thereof.

10. The loudspeaker according to claim 1 further comprising a three-point magnetic suspension configured as a sub-assembly inside the loudspeaker enclosure, and arranged to suspend a coupler between three points inside the enclosure.

11. The loudspeaker according to claim 1 further comprising a positioning indicator arranged so as to be screened off, but made visible to a user only when being positioned in an ideal listening position of a pair of loudspeaker enclosures.

12. The loudspeaker according to claim 11, wherein the positioning indicator is a light emitting diode (LED) positioned inside the bass port of the loudspeaker enclosure.

13. The loudspeaker according to claim 12, wherein the positioning indicator has the function also of a clipping indicator, signalling to the user when the amplitude of the input signal is to be reduced.

14. The loudspeaker according to claim 11, wherein the indicator is powered by piezo transducers and/or diode rectifiers picking up vibrations from the coupler and thereby generating electrical current to drive the indicator; or alternatively toroidal chokes and/or inductors, whereby a wire carrying an audio signal to the loudspeaker will generate an electromagnetic field sufficient to charge a capacitor to drive the indicator; or alternatively a magnetic propeller arrangement comprising radially housed magnets on a small propeller that is put into rotational motion by a more powerful magnet held at an angle from the propeller, the rotating propeller generating a reverse current to drive the indicator.

15. An article comprising the loudspeaker according to claim 1, wherein the article is one selected from the group consisting of musical instrument amplifiers, amplifiers specialized for sound reproduction in cinema and concert hall environments, integrated loudspeakers for electronic devices and headphones.

16. The article according to claim 15, wherein the electronic devices are mobile phones and laptops.

17. The loudspeaker according to claim 1, wherein one surface of the driver radiates directly into the external environment and one surface of the passive acoustic diaphragm radiates directly into the first band-pass chamber while the other surface of the driver and the passive acoustic diaphragm radiate into the sealed acoustic suspension chamber.

* * * * *